US006531039B2

(12) United States Patent
Kohut

(10) Patent No.: US 6,531,039 B2
(45) Date of Patent: Mar. 11, 2003

(54) ANODE FOR PLATING A SEMICONDUCTOR WAFER

(75) Inventor: Stephen J. Kohut, Chandler, AZ (US)

(73) Assignee: Nikko Materials USA, Inc., Chandler, AZ (US)

( * ) Notice: Subject to any disclaimer, the term of this patent is extended or adjusted under 35 U.S.C. 154(b) by 11 days.

(21) Appl. No.: 09/790,078

(22) Filed: Feb. 21, 2001

(65) Prior Publication Data

US 2002/0112953 A1 Aug. 22, 2002

(51) Int. Cl.[7] ..... C25B 11/04

(52) U.S. Cl. ..... 204/292; 204/293; 204/280; 204/281; 148/549; 148/552; 148/554; 148/557; 148/650; 148/651; 148/678; 148/679; 148/680; 148/684; 148/706

(58) Field of Search ..... 204/280, 281, 204/292, 293; 148/549, 552, 554, 557, 650, 651, 678, 679, 680, 684, 706

(56) References Cited

U.S. PATENT DOCUMENTS

| | | | | |
|---|---|---|---|---|
| 2,201,555 A | | 5/1940 | Corson | 148/11.5 |
| 3,589,430 A | | 6/1971 | Barrow et al. | 164/76 |
| 4,290,823 A | | 9/1981 | Dompas | 148/2 |
| 4,352,697 A | | 10/1982 | Adams et al. | 148/2 |
| 4,390,586 A | | 6/1983 | Lemelson | 428/209 |
| 4,566,915 A | | 1/1986 | Ikushima et al. | 148/11.5 C |
| 4,718,476 A | | 1/1988 | Eibe | 164/476 |
| 4,733,717 A | | 3/1988 | Chia et al. | 164/476 |
| 4,874,436 A | | 10/1989 | Ogata et al. | 148/2 |
| 4,946,575 A | | 8/1990 | Dompas | 204/288 |
| 5,039,355 A | | 8/1991 | Daumas et al. | 148/11.5 C |
| 5,052,470 A | | 10/1991 | Buxmann | 164/467 |
| 5,354,388 A | * | 10/1994 | Nojiri et al. | 148/554 |
| 5,366,001 A | | 11/1994 | Freedman et al. | 164/475 |
| 5,463,886 A | | 11/1995 | Seitz | 72/13 |
| 6,113,771 A | | 9/2000 | Landau et al. | 205/123 |
| 6,395,110 B2 | * | 5/2002 | Mizoguchi et al. | 148/554 |

* cited by examiner

*Primary Examiner*—Bruce F. Bell
(74) *Attorney, Agent, or Firm*—Mark Kusner; Michael A. Jaffe

(57) ABSTRACT

An anode for use in electroplating semiconductor wafers, comprising a metal plate formed from a generally continuous casting process that is essentially free of voids or cracks, the casting being thermo-mechanically worked until the anode has an average grain size of less than 100 $\mu$m.

16 Claims, 3 Drawing Sheets

40'

40

72
60
40'

60
72
40'
3
3
54
56
53
2
2
10
52
40
14
12
16
24
26
52
M
22
32
34

LONGITUDINAL MAG: 50X

TRANSVERSE MAG: 50X

LONGITUDINAL MAG: 50X

TRANSVERSE MAG: 50X

ANODE FOR PLATING A SEMICONDUCTOR WAFER

FIELD OF THE INVENTION

The present invention relates generally to the manufacture of semiconductors, and more particularly, to an anode for plating a semiconductor wafer.

BACKGROUND OF THE INVENTION

A recent trend in manufacturing semiconductors utilizes an electroplating process to deposit a metal, typically copper, onto semiconductor substrates. In a conventional electroplating process, a soluble copper anode is disposed in an electrolytic solution adjacent the substrate to be plated. The anode provides metallic ions to replenish those that are depleted during the plating process.

In such a process, it is important to produce a uniform layer of metal on the semiconductor substrate. A number of factors affect plating of the substrate. These include the uniformity of the spacing between the anode and the semiconductor wafer, the uniformity of the anode surface during dissolution of the anode and the uniformity of flow of the electrolyte between the anode and the wafer substrate to be coated.

Conventional anodes used in electroplating semiconductor substrates are usually produced as a cast ingot. Typically, these anodes have a very coarse grain structure and may include casting defects such as shrinkage pipes, voids and cracks. In addition, some copper anodes include a doping agent, such as phosphorus, to enhance performance. The doping agents in such anodes tend to be segregated within the anode structure as a result of the solidification process during casting. It has been known to mechanically roll and thermo-mechanically work the billets to provide some refinement of the grain size, but such rolling process does not always eliminate the aforementioned defects in the casting structure. In this respect, the anodes produced by casting and rolling typically have coarse grain sizes (greater than 140 $\mu$m) and still contain casting defects.

The aforementioned casting defects and the segregation of the doping agent within a cast anode can produce an irregular anode surface during the electroplating process as the metal on the surface of the anode dissolves into the electrolyte. This non-uniform dissolution of the anode can interfere with the uniformity of the anode-to-wafer spacing, and can also distort the uniformity of the flow of electrolyte between the anode and wafer, both of which can adversely affect the plating of the wafer substrate.

The present invention overcomes these and other problems and provides an improved anode for electroplating semiconductor wafers.

SUMMARY OF THE INVENTION

In accordance with the present invention, there is provided an anode for use in electroplating semiconductor wafers. The anode is comprised of a metal plate formed from a metal casting that is essentially free of voids or cracks. The casting is thermo-mechanically worked until the metal of the plate has an average grain size of less than 100 $\mu$m.

In accordance with another aspect of the present invention, there is provided a method of forming an anode for use in plating a semiconductor wafer, comprising the steps of:

a) casting a metal into an ingot using a semi-continuous caster; and b) thermo-mechanically working the ingot at a temperature less than 85% of the melting temperature of the metal to reduce the cross-sectional area by at least 20% until the metal has a grain size less than 100 $\mu$m.

It is an object of the present invention to provide an anode for use in electroforming semiconductor wafers.

It is another object of the present invention to provide an anode as described above that is essentially free of voids, cracks or other casting defects.

A still further object of the present invention is to provide an anode as described above that has an average grain size of less than 100 $\mu$m.

A still further object of the present invention is to provide a method of forming an anode as described above.

These and other objects and advantages will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF PREFERRED EMBODIMENT

Figures 1, 2, 3, 4:
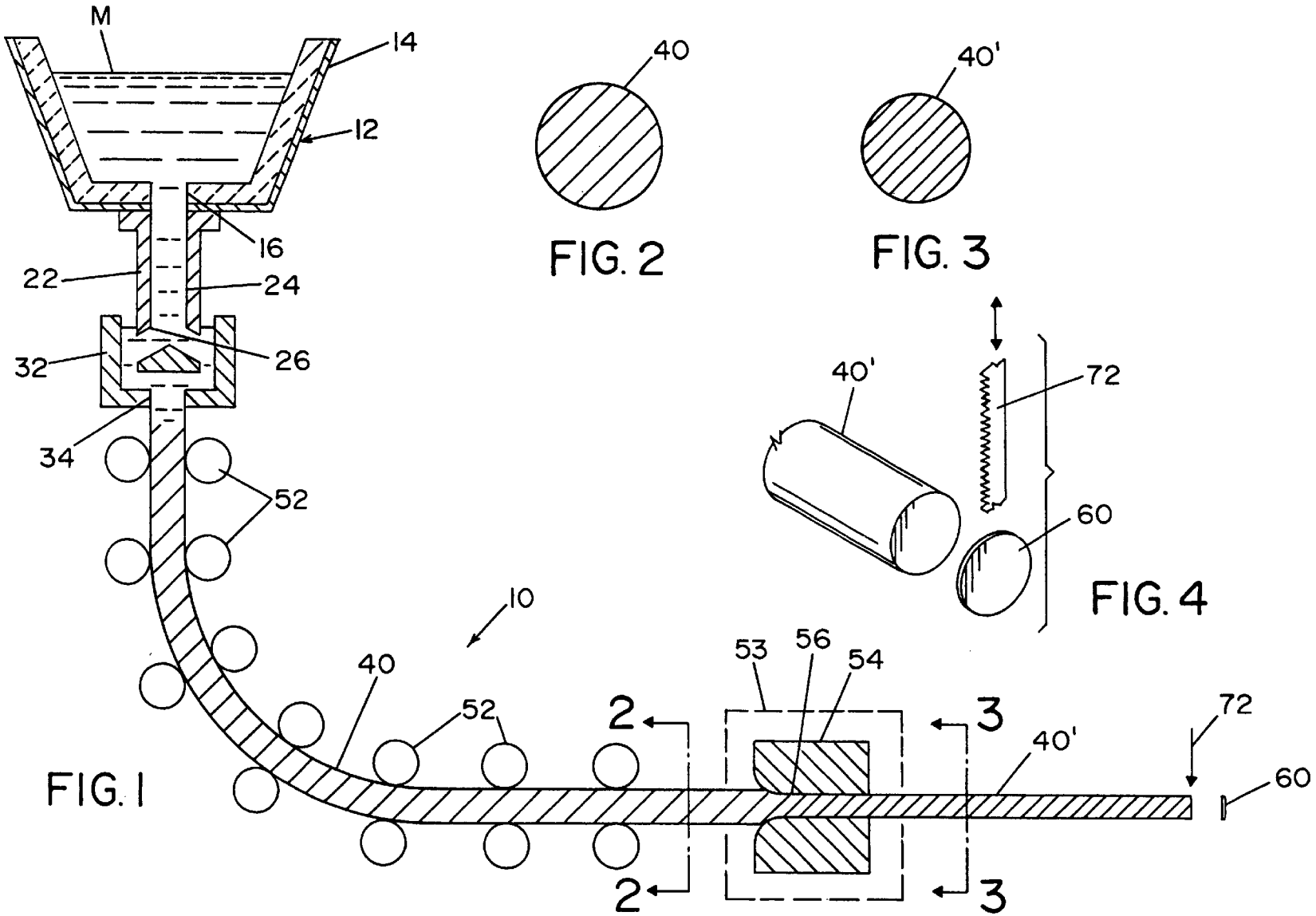
FIG. 1 is a schematic illustration of a process for forming an anode for electroplating semiconductor wafers in accordance with the present invention.
FIG. 2 is a cross-sectional view taken along lines 2—2 of FIG. 1 showing an anode bar formed in accordance with the present invention.
FIG. 3 is a cross-sectional view taken along lines 3—3 of FIG. 1 showing a worked anode bar in accordance with the present invention.
FIG. 4 is a perspective view of an anode cut from a worked anode bar in accordance with the present invention.

Referring now to the drawings wherein the showings are for the purpose of illustrating a preferred embodiment of the invention only, and not for the purpose of limiting same, FIG. 1 is a schematic illustration of a process line 10 for forming an anode 60 to be used in an electroplating process to plate semiconductor substrates. Process line 10 includes a vessel 12 that forms a reservoir 14 of a molten metal M. Vessel 12 may be a furnace, or as illustrated in FIG. 1, a tundish for holding molten metal M. Vessel 12 is adapted to hold a molten metal M that will ultimately form anode 60. Metal M may be copper or another plating metal, such as silver, gold or alloys thereof. Metal M is preferably copper or an alloy thereof Metal M may contain doping agents, such as phosphorus, to facilitate uniform distribution on the semiconductor wafer substrate, as is conventionally known.

An opening 16 at the bottom of vessel 12 communicates with a nozzle 22 having a bore 24 formed therethrough. Bore 24 extends through nozzle 22 to exit port 26 at the lower end of nozzle 22. The lower end of nozzle 22, and more specifically, port 26, is disposed within a mold 32. As illustrated in the drawings, nozzle 22 is adapted to be positioned within mold 32 with port 26 submerged below the surface of the molten metal M within mold 32. In this respect, the flow of molten metal M from vessel 12 through nozzle 22 is controlled (by means not shown) to establish a certain level of molten metal M within mold 32. Mold 32 has an opening 34 in the bottom thereof through which metal M flows. Opening 34 is preferably circular in shape. Mold 32 is chilled by conventional means (not shown) such that a generally solid and continuous cylindrical anode bar 40 exits mold 32 through opening 34. Anode bar 40 exits mold 32 in a generally vertical orientation and is directed by rollers 52 to a horizontal orientation, as illustrated in FIG. 1. Mold 32 is preferably cooled at a rate to produce an anode bar 40 having relatively coarse grains that have an average grain size of less than 250 $\mu$m. Anode bar 40 is continuously cast to avoid defects, such as pipes, voids and cracks, found in conventionally cast ingots. Further, the semi-continuous casting of anode bar 40 eliminates the inner dendritic core structure typically found in conventionally cast anode ingots.

The generally continuous casting process heretofore described eliminates many of the undesirable characteristics typically found in conventional cast anodes. Many types of processes may be used to provide anode bar 40 as heretofore described. A Brush Wellman process bearing the trade name Equacast™ is a method of casting that finds advantageous application in forming an anode bar 40 as heretofore described.

In accordance with another aspect of the present invention, subsequent to casting anode bar 40, anode bar 40 undergoes a thermo-mechanical working to reduce its grain size. Anode bar 40, formed by the continuous casting process as described above, is thermo-mechanically worked to have an average grain size that is less than 100 $\mu$m. The desired grain size of anode bar 40 following the thermo-mechanical working, is preferably less than 100 $\mu$m, more preferably is less than 90 $\mu$m and most preferably is less than 80 $\mu$m.

The thermo-mechanical working may be performed by a mechanical rolling operation or by a forging operation. But in a preferred embodiment of the present invention, anode bar 40 is thermo-mechanically worked by an extrusion process. In FIG. 1, an extruder 52 is schematically illustrated as part of process line 10 to provide a continuous processing of anode bar 40. In a preferred extrusion process, anode bar 40 is preferably heated to, or maintained at, a temperature of between 70% and about 85% of its melting point temperature, and is extruded at such temperature. The extrusion of anode bar 40 preferably reduces the cross-sectional area of anode bar 40 by about 20% or more. The size reduction may be accomplished by several extrusion steps, but in a preferred embodiment, as shown in the drawings, the thermo-mechanical working to reduce the size of anode bar 40 is accomplished by a single extrusion step. In the embodiment shown, heated anode bar 40 is forced through an extrusion die 54 having a die opening 56. The cross-sectional area of die opening 56 is less than 80% of the original cross-sectional area of anode bar 40.

FIG. 2 is a view of anode bar 40 that schematically illustrates the cross-sectional area of anode bar 40 prior to thermo-mechanical working. FIG. 3 is a cross-sectional view of a thermo-mechanically worked anode 40', schematically illustrating the relative size reduction that anode bar 40 undergoes as a result of the thermo-mechanical working by extrusion. As will be appreciated, the showings of FIGS. 2 and 3 are for the purpose of illustration and are not intended to depict an exact size reduction. In this respect, as indicated above, anode bar 40 is preferably worked in one or more stages to produce an area reduction of about 70 to 80% and to produce an average grain size of less than 100 $\mu$m.

The mechanically worked anode bar 40' is cooled in a manner to minimize the affect on the grain size thereof. When cooled, or when at a suitable temperature, worked anode bar 40' is sliced into cylindrical disks 60 by a cutting process, that is schematically illustrated and designated 72 in FIG. 4. Disks 60, shown in FIG. 4, are used as the anodes in the above-referred deposition process for plating semiconductor substrates.

Figure 5A:
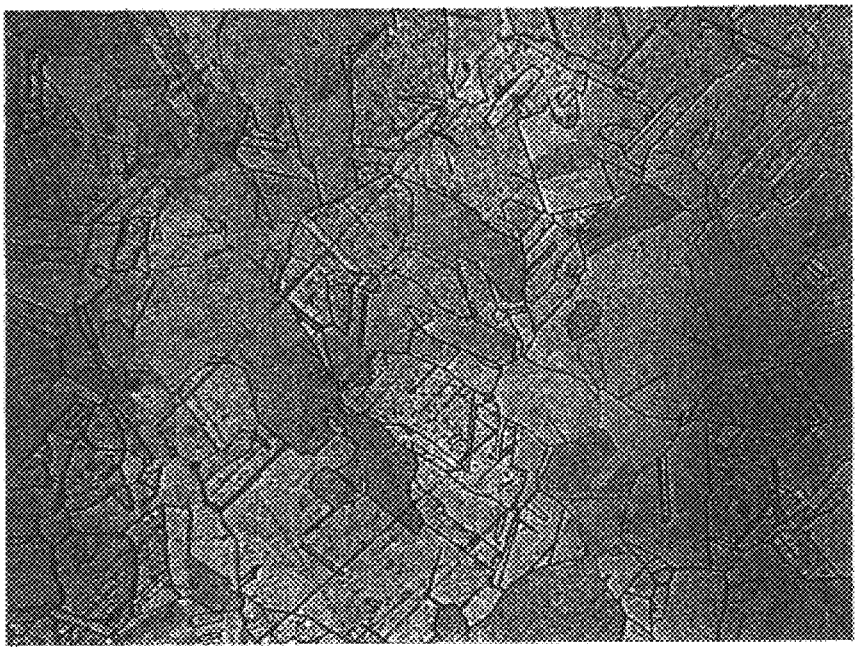
FIG. 5A (PRIOR ART)
FIGS. 5A and 5B are micrographs at 50×magnification showing respectively, a longitudinal section and a transverse section of a conventional cast anode used in electroplating semiconductor wafers.
Figure 5B:
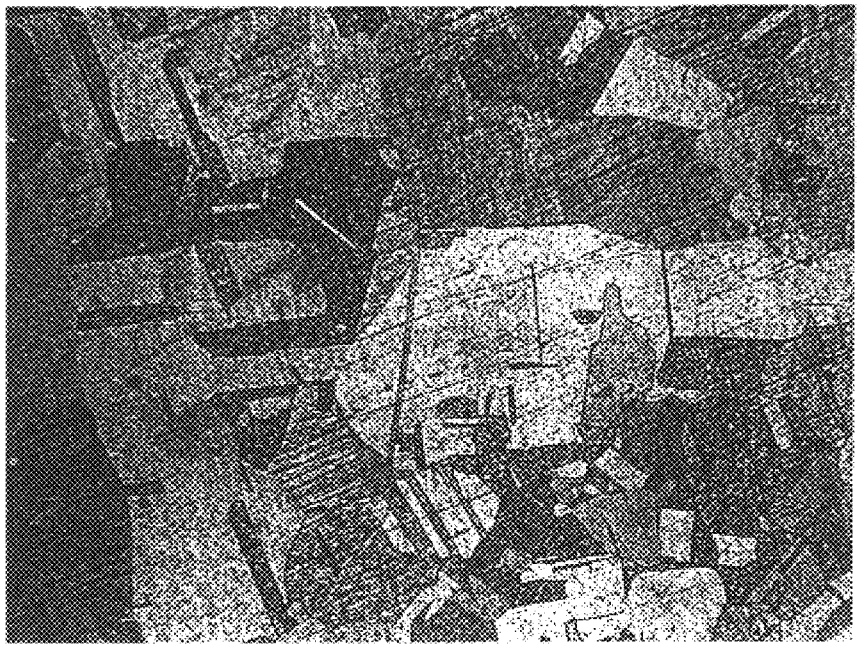
FIG. 5B (PRIOR ART)
Figure 6A:
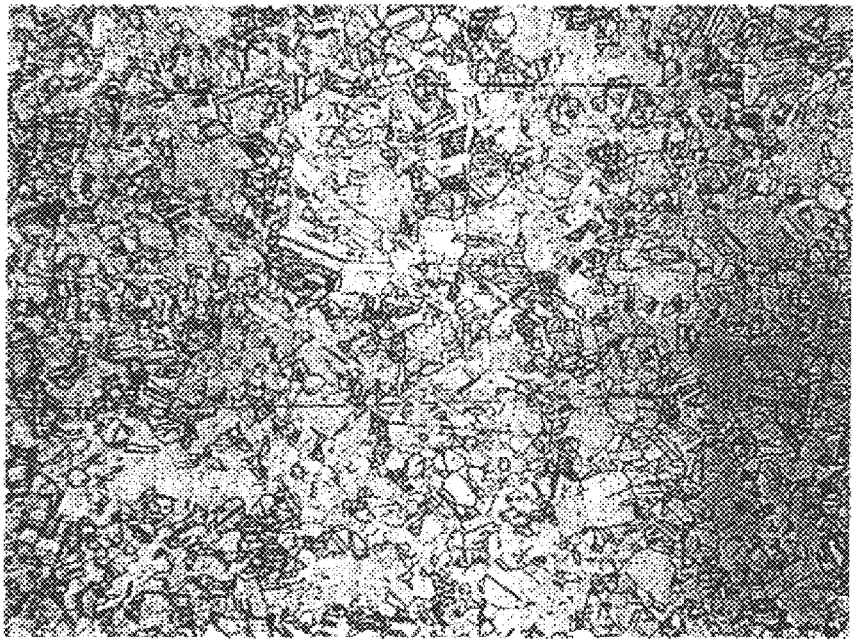
FIGS. 6A and 6B are micrographs at 50×magnification showing respectively, a longitudinal section and a transverse section of an anode, made according to the present invention, for use in electroplating semiconductor wafers.
Figure 6B:
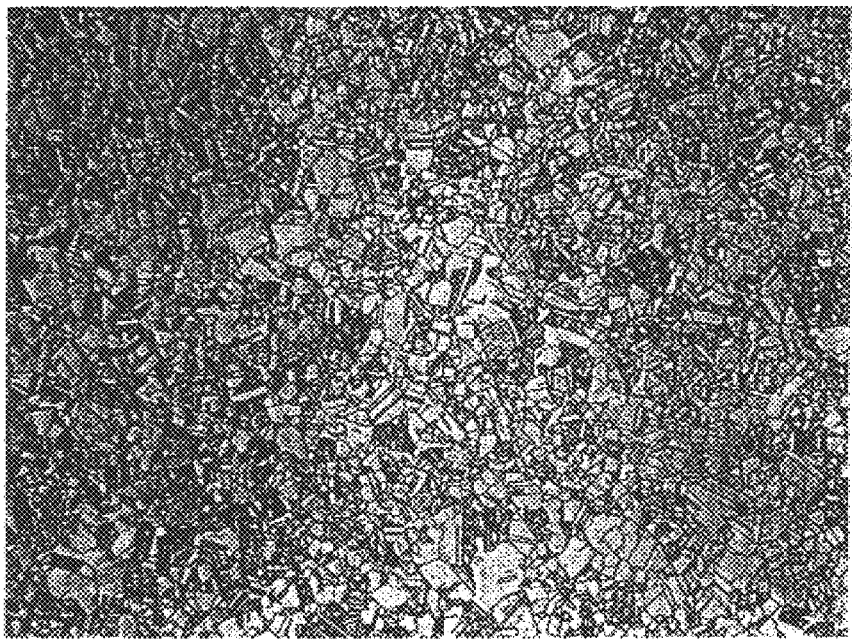

The present invention thus provides an anode 60 having a grain size of less than 100 $\mu$m that is essentially free of casting defects, such as shrinkage pipes, voids and cracks, typically found in cast anodes. FIGS. 5A and 5B are sectional views at 50×magnification of a conventional anode. FIGS. 6A and 6B are sectional views at 50×magnification of an anode 60 formed in accordance with the present invention. As shown in FIGS. 6A and 6B, an anode 60 formed in accordance with the present invention has much smaller grains as contrasted with a conventional cast anode 60, as shown in FIGS. 5A and 5B.

In an electroplating process, anode 60 is disposed in an electrolyte, typically containing sulfuric acid. It has been found that anode 60 dissolves more uniformly than conventional cast anodes when used in an electrodeposition process. The uniform dissolution of anode 60 maintains the uniformity of the anode-to-wafer spacing and the uniformity of the solution flow between anode 60 and the surface of the wafer substrate to be plated. All of these are important factors in producing the desired uniform deposition of metal on the wafer surface. In this respect, it is believed that the reduced grain size of anode 60, results in a greater number of grain boundaries per unit area, as contrasted with conventional cast anodes that have larger average grain sizes. Because the grain boundaries are locations of stored energy, they represent preferential reaction sites when disposed within the electrolytic solution of an electroplating process. The larger total grain area per unit of anode 60, together with the smaller grain size, produces a more uniform dissolution of the surface of anode 60, as the smaller grain particles dissolve away from the surface thereof. Doping agents, such as phosphorus that may be present in anode 60, are also more uniformly distributed in anode 60, and result in a more uniform coating of the wafer substrate.

The foregoing description is of a specific embodiment of the present invention. It should be appreciated that this embodiment is described for purposes of illustration only, and that numerous alterations and modifications may be practiced by those skilled in the art without departing from the spirit and scope of the invention. For example, anode bar 40 may be thermo-mechanically worked by other than an extrusion process. Specifically, anode bar 40 may be heated to a temperature of less than 80% of its melting point and subjected to compressive rolling using conventional rolling mills to induce a reduction in its cross-sectional area resulting in the desired reduction of grain size. The rolling may be performed in a plurality of passes to obtain the desired final grain size. Further, anode bar 40 may be thermo-mechanically worked by a forging process. As indicated above, the temperature of anode bar 40 is preferably less than 80% of its melting point temperature during the forging operation. It is intended that all such modifications and alterations be included insofar as they come within the scope of the invention as claimed or the equivalents thereof.

Having described the invention, the following is claimed:

1. An anode plate for use in electroplating semiconductor wafers, comprising a metal plate formed from a metal casting that is essentially free of voids and cracks as cast, said casting being thermo-mechanically worked, until said plate has an average grain size of less than 100 $\mu$m, wherein said thermo-mechanically worked casting is sliced into cylindrical disks by a cutting process to form said anode plate.

2. An anode plate as defined in claim 1, wherein said plate is made of metal selected from the group consisting of copper, silver, gold, platinum, tin, lead and alloys thereof.

3. An anode plate as defined in claim 1, wherein said plate is soluble in a solution containing sulfuric acid.

4. An anode plate as defined in claim 1, wherein said plate ranges in thickness from about 0.25" to about 6.00".

5. An anode plate as defined in claim 1, wherein said plate contains phosphorus.

6. An anode plate as defined in claim 5, wherein said phosphorus ranges in concentration from about 0.001% to about 0.100% by weight.

7. A method of forming an anode plate for use in plating a semiconductor wafer, comprising the steps of:

a) casting a metal into an ingot using a semi-continuous caster, said ingot being essentially free of voids and cracks as cast;

b) thermo-mechanically working said ingot at a temperature less than 85% the melting temperature of said metal to reduce a cross-sectional area by at least 20% until said metal has a grain size less than 100 $\mu$m; and (c) slicing said thermo-mechanically worked ingot into cylindrical disks to form said anode plate.

8. An anode for use in plating a semiconductor wafer formed according to the method of claim 7.

9. An anode plate for use in electroplating semiconductor wafers, comprising a metal plate formed from a metal casting that is essentially free of voids or cracks, said casting being thermo-mechanically worked by an extrusion process, until said plate has an average grain size of less than 100 $\mu$m, wherein said thermo-mechanically worked casting is sliced into cylindrical disks by a cutting process to form said anode plate.

10. An anode plate as defined in claim 9, wherein said plate is made of metal selected from the group consisting of copper, silver, gold, platinum, tin, lead and alloys thereof.

11. An anode plate as defined in claim 9, wherein said plate is soluble in a solution containing sulfuric acid.

12. An anode plate as defined in claim 9, wherein said plate ranges in thickness from about 0.25" to about 6.00".

13. An anode plate as defined in claim 9, wherein said plate contains phosphorus.

14. An anode plate as defined in claim 13, wherein said phosphorus ranges in concentration from about 0.001% to about 0.100% by weight.

15. A method of forming an anode plate for use in plating a semiconductor wafer, comprising the steps of:

a) casting a metal into an ingot using a semi-continuous caster;

b) using an extrusion process to thermo-mechanically work said ingot at a temperature less than 85% the melting temperature of said metal to reduce a cross-sectional area by at least 20% until said metal has a grain size less than 100 $\mu$m; and (c) slicing said thermo-mechanically worked ingot into cylindrical disks to form said anode plate.

16. An anode for use in plating a semiconductor wafer formed according to the method of claim 15.

* * * * *